US006494364B2

(12) United States Patent
Shepherd

(10) Patent No.: US 6,494,364 B2
(45) Date of Patent: Dec. 17, 2002

(54) SELF-SERVICE TERMINAL

(75) Inventor: Collette Shepherd, Dundee (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/815,352

(22) Filed: Mar. 22, 2001

(65) Prior Publication Data

US 2001/0025881 A1 Oct. 4, 2001

(30) Foreign Application Priority Data

Mar. 28, 2000 (GB) ..... 0007361

(51) Int. Cl.[7] ..... G06F 17/60
(52) U.S. Cl. ..... 235/379; 235/492
(58) Field of Search ..... 235/379, 492, 235/437; 705/16

(56) References Cited

U.S. PATENT DOCUMENTS 4,593,183 A 6/1986 Fukatsu
4,882,473 A 11/1989 Bergeron et al.
5,484,993 A 1/1996 Seto et al.
5,791,512 A * 8/1998 Kanatsuka ..... 221/130
5,850,079 A * 12/1998 Ohwa et al. ..... 194/351
5,929,413 A 7/1999 Gardner

FOREIGN PATENT DOCUMENTS

| | | |
|---|---|---|
| EP | 0780814 | 6/1997 |
| EP | 0854461 | 7/1998 |
| EP | 0945816 | 9/1999 |
| GB | 2119993 | 11/1983 |
| GB | 2143355 | 2/1985 |

* cited by examiner

*Primary Examiner*—Thien M. Le
*Assistant Examiner*—Lisa M. Caputo
(74) *Attorney, Agent, or Firm*—Francis L. Conte

(57) ABSTRACT

A self-service terminal (10) for preventing fraud and a module (50) for use in a fraud-resistant self-service terminal (10) are described. The SST (10) comprises a fascia (12) defining a card entry slot (22), and a card reader module (50) located behind the card entry slot (22). The SST (10) further comprises a terminal shutter (34) operable to cover the card entry slot (22), and sensors (68,86,88,90,94) for detecting the location of a card within the module (50). If the sensors detect a card within the module (50) that cannot be transported then the SST (10) operates the shutter (34) to cover the card entry slot (22) and prevent access to the card. A method of preventing fraud using the SST (10) is also described.

19 Claims, 3 Drawing Sheets

SELF-SERVICE TERMINAL

BACKGROUND OF THE INVENTION

The present invention relates to a self-service terminal (SST). In particular, the invention relates to a fraud-resistant SST, such as a fraud-resistant ATM (automated teller machine), and to a motorized card reader module for use in such an SST.

ATMs typically store large amounts of cash. This makes them vulnerable to attack by thieves. To combat physical attack, ATMs include a safe for storing the cash. However, ATMs are also vulnerable to attack by fraud.

One type of fraud involves a third party placing a length of thin, strong, material over a card entry slot in the ATM. The material is so thin that it may not be noticed by an unwary user of the ATM. The material is selected so that it prevents a user's card from fully entering a motorized card reader module located behind the card entry slot. This causes the card to jam so that it cannot be drawn in or ejected by the card reader module. When this happens, the user generally assumes that the ATM has gone out of service and goes away from the ATM, leaving his/her card jammed in the card reader module.

The third party can then extract the card from the card reader module, remove the thin material, and (if the third party has observed the user's PIN) use the card to withdraw cash from the ATM.

SUMMARY OF THE INVENTION

It is an object of an embodiment of the present invention to reduce the possibility of this type of fraud.

According to a first aspect of the present invention there is provided a self-service terminal comprising a fascia defining a card entry slot, and a card reader module located behind the card entry slot, characterized in that the terminal further comprises a terminal shutter operable to cover the card entry slot in response to the card reader module detecting a card within the module that cannot be transported.

By virtue of this aspect of the invention when a card is stuck within the module the terminal is able to cover the card entry slot, thereby preventing a third party or the authorized card holder from removing the card. This safeguards the card without damaging it in any way.

It will be appreciated that the card entry slot is a slot defined by the fascia through which a card passes to enter or exit the card reader module.

It will also be appreciated that the terminal shutter is provided in addition to any shutter that is located within the card reader module.

Preferably, the shutter is retractable. The shutter may be retracted by a manually operable electronic or mechanical mechanism accessible on opening up the terminal. For all example, a latch mechanism for opening the shutter may be accessible when the fascia is opened.

In one embodiment, the shutter covers only the card entry slot. The shutter may be located to the front of the card entry slot, or to the rear of the card entry slot. If the shutter is located to the front of the card entry slot, the slot may be located in a recess.

In another embodiment, the shutter covers the entire fascia, thereby covering any display, keypad, or other user interface element located within the fascia. In such an embodiment, the shutter may be transparent, or may have a transparent portion, to allow a user to view a message on the display explaining what has occurred.

The terminal may activate an alarm on detecting a card within the module that cannot be transported. This alarm may be audible or visual, and may be relayed automatically to an appropriate person, for example to a person authorized to service the terminal.

The card reader module may detect that a card cannot be transported using sensors. The event of a card having jammed may be indicated by any convenient technique. For example, where a first sensor detects the presence of a card and a second sensor does not detect the presence of the card a predetermined time after the first sensor detected the presence of the card. Another example is where a sensor continuously detects the presence of a card for a predetermined time interval. A further example is where a sensor detects the presence of a card for a predetermined time during attempted transportation of the card in a forward direction and the same sensor detects the presence of the card for a predetermined time during attempted transportation of the card in a reverse direction. Any one or any combination of these techniques may be used to detect that a card cannot be transported.

The terminal may be an ATM.

According to a second aspect of the present invention there is provided a self-service terminal including a card reader module, characterized in that the terminal includes a terminal shutter operable to block access to the card reader module in response to the card reader module detecting a card jammed within the module.

According to a third aspect of the present invention there is provided a method of preventing fraud, the method comprising the steps of: providing a terminal shutter for covering a card entry slot, where the slot guides a card between a user and a card reader module; detecting entry of a card into the card reader module; monitoring transport of the card within the card reader module; and, in response to detection of a failure of the card reader module to transport the card correctly, activating the shutter to cover the card entry slot.

The method may include the further step of displaying on a monitor a message informing the user about the capture of his/her card.

The method may include the steps of detecting continued activation of a first sensor but not detecting activation of a second sensor within a predetermined time. The first sensor may be a width sensor for sensing the width of the card, and/or a magnetic stripe detecting sensor for detecting the correct orientation of a card. The second sensor may be a read head sensor located in the vicinity of a magnetic card reading head within the card reader module.

According to a fourth aspect of the invention there is provided a motorized card reader module for use in a self-service terminal, the module comprising at least two sensors for detecting the presence of a magnetic stripe card, characterized in that the module generates an alert signal in the event that a card has entered the module but cannot be transported by the module.

By virtue of this aspect of the invention, a card reader module provides a signal for alerting an ATM controller that an obstruction may be present in the module, where the obstruction may be the result of an attempted fraud.

BRIEF DESCRIPTION OF THE DRAWINGS

These and other aspects of the invention will be apparent from the following specific description, given by way of example, with reference to the accompanying drawings, in which.

DETAILED DESCRIPTION

Figure 1:
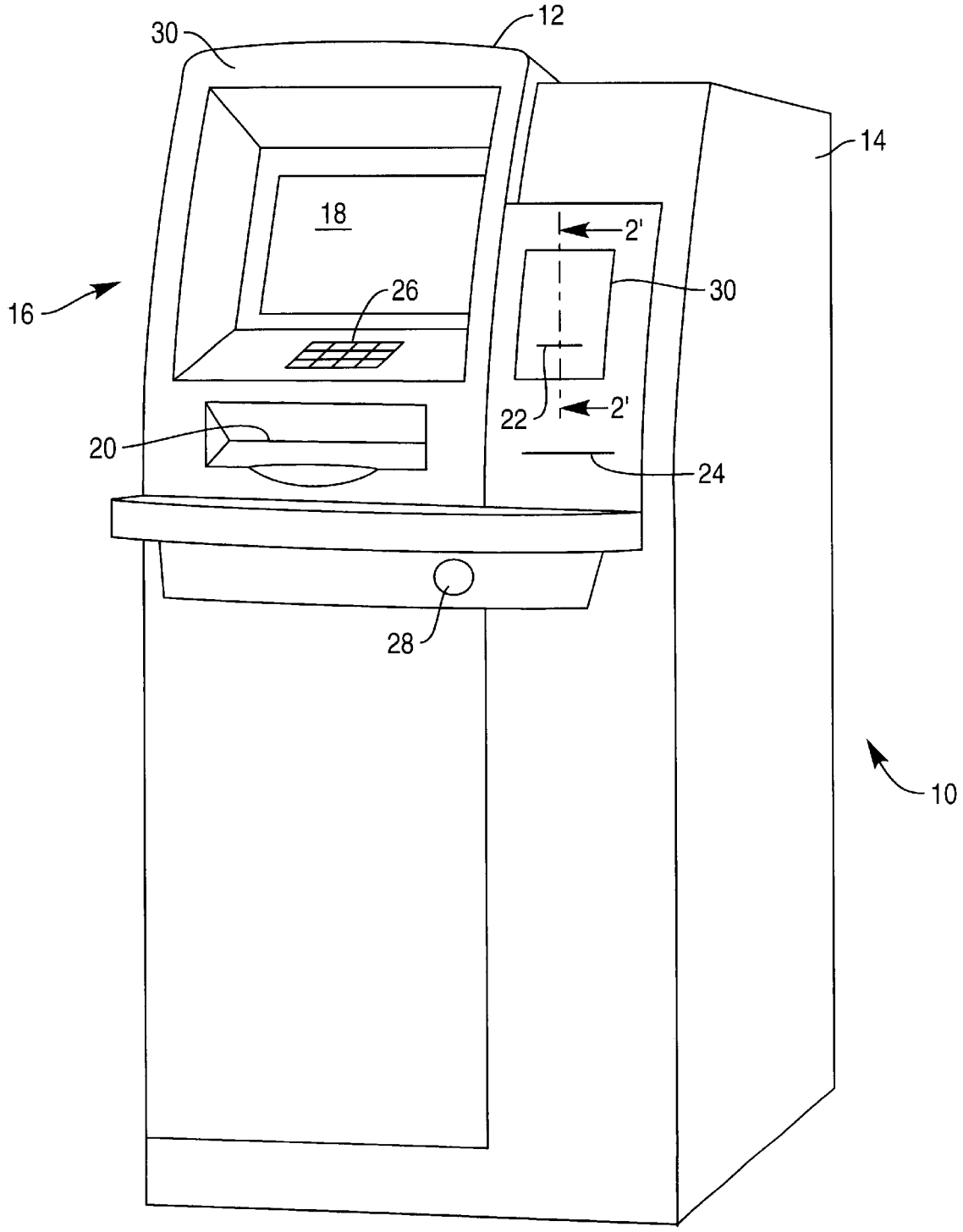
FIG. 1 is a perspective view of a self-service terminal according to one embodiment of the present invention.

Referring to FIG. 1, which shows a perspective view of an ATM 10 according to one embodiment of the invention, the ATM 10 comprises a chassis (not shown) for supporting exterior panels 14 and internal ATM modules (not shown in FIG. 1). The fascia 12 incorporates a user interface 16. The fascia 12 defines a plurality of slots so that when the fascia 12 engages fully with the chassis and panels 14 the slots align with user interface elements located within the ATM 10.

The user interface 16 comprises a display 18, a cash dispense slot 20, a card entry/exit slot 22 (herein referred to as a card entry slot), a receipt slot 24, and an encrypting keypad 26.

The fascia 12 has a lock mechanism 28 for securing the fascia 12 to and for releasing the fascia 12 from the chassis and panels 14. The fascia 12 also has an enclosure 30 surrounding the card slot 22.

Figure 2:
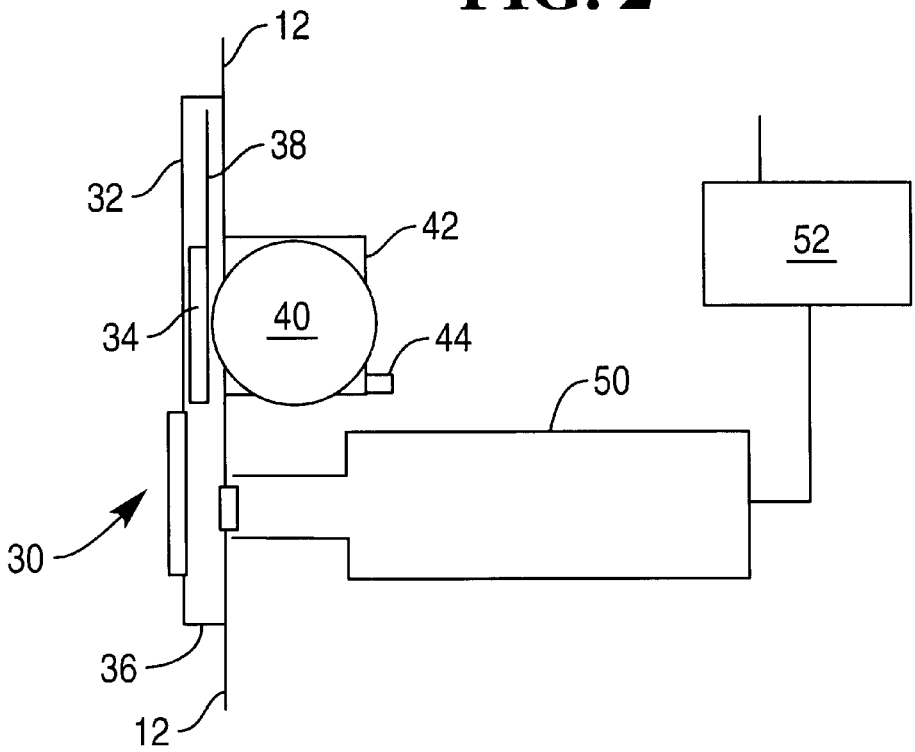
FIG. 2 is a schematic sectional view of part of the terminal of FIG. 1 along line 2'—2'.

Reference is now made to FIG. 2, which illustrates a motorized card reader module 50 located behind and aligned with the card entry slot 22. The module 50 is connected to an ATM controller 52, which is also connected to the display 18 (FIG. 1), the encrypting keypad 26 (FIG. 1), and other conventional ATM modules which are not described in detail herein.

The enclosure 30 has a housing portion 32 for storing a retractable terminal (ATM) shutter 34, and a lip portion 36 opposite the housing portion 32. The ATM shutter 34 is outside of and spaced from the card reader module 50.

The shutter 34 has a rack 38 meshingly engaged with a pinion 40 coupled to a stepper motor 42. The stepper motor 42 is located behind and coupled to the fascia 12.

Anti-clockwise rotation of the pinion 40 by the stepper motor 42 lowers the shutter 34 until the shutter 34 locates behind the lip portion 36. When the shutter 34 is in the lowered position, clockwise rotation of the stepper motor 42 raises the shutter 34 until the shutter 34 is fully enclosed by the housing portion 32. The motor 42 also includes an override button 44 for actuating the motor 42 to raise the shutter 34.

The card reader module 50 is made by Sankyo (trade mark) and is available from 1-17-2, SHINBASHI, MINATO-KU, TOKYO, 1058633, Japan.

Figure 3:
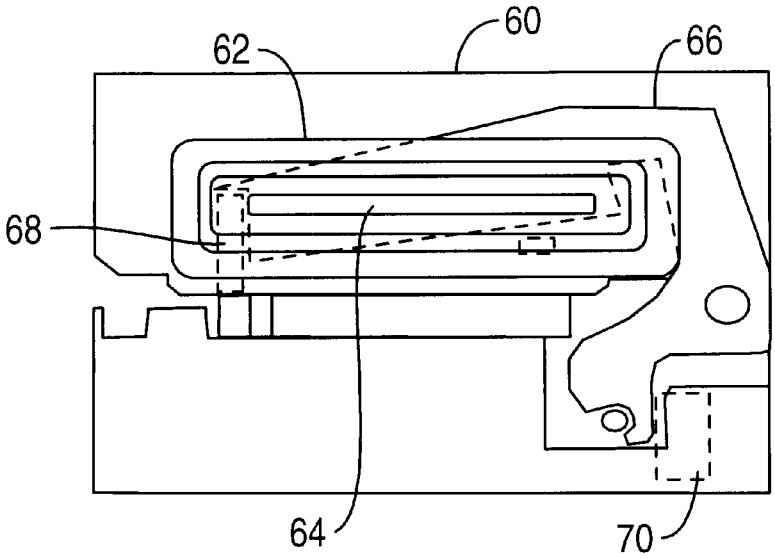
FIG. 3 is a front view of a motorized card reader module for use in the terminal of FIG. 1.
Figure 4:
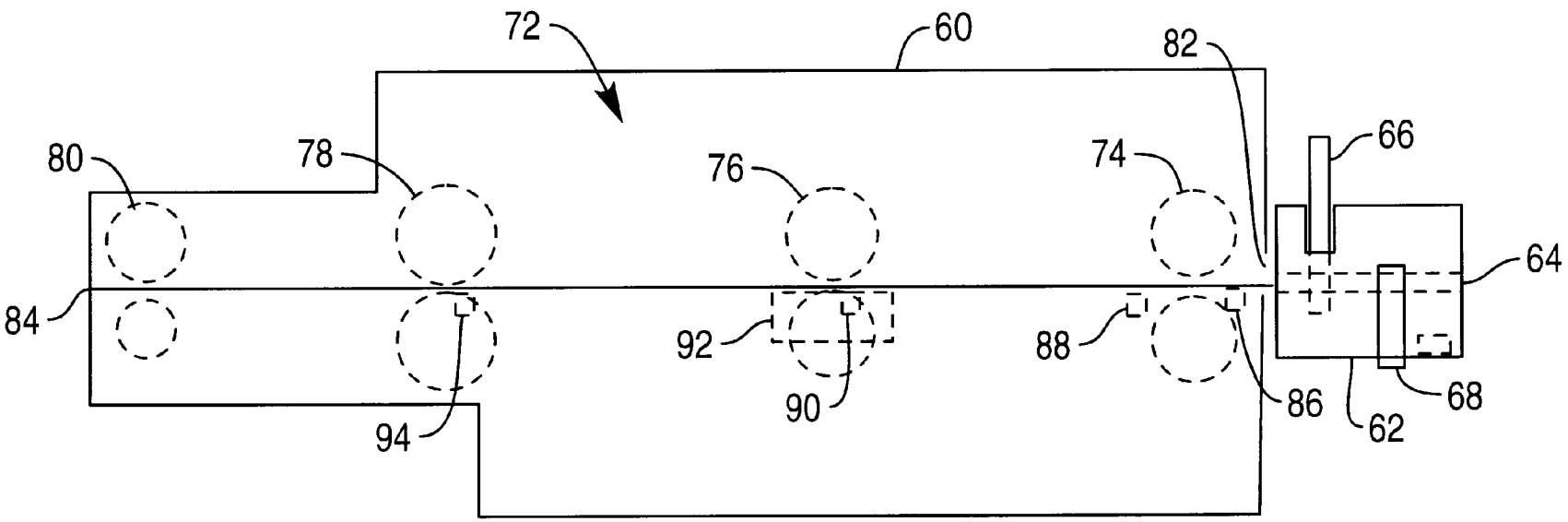
FIG. 4 is a simplified side view of the module of FIG. 3.

Reference is now made to FIGS. 3 and 4, which show the card reader module 50 in more detail. Card reader module 50 comprises a housing 60 coupled to a throat portion 62 and is suitable for reading a standard size magnetic stripe card.

The throat portion 62 defines a slot 64 into which a magnetic stripe card may be inserted, and includes a shutter 66 pivotally coupled to the housing 60. With the shutter 66 in the open position, a card may be conveyed between the housing 60 and the throat portion 62; whereas, with the shutter 66 in the closed position no card may pass between the throat portion 62 and the housing 60. Once the leading edge of a card passes the shutter 66, the shutter 66 is biased against the top of the card so that the shutter 66 automatically closes once the trailing edge of the card clears the shutter 66.

The throat portion 62 includes a card width detection sensor 68. This sensor 68 is deflected by a card on insertion and ejection of the card. If a user inserts a card into the throat portion 62 then the card width sensor 68 detects the presence of this card and allows the shutter 66 to open.

The housing 60 includes a shutter detect sensor 70 (FIG. 3) for detecting whether the shutter 66 is open or closed. The housing 60 also includes a linear transport mechanism 72 comprising four pairs of rollers 74,76,78,80 and associated stretchable endless belts (not shown) for transporting a card when it is within the housing 60. The housing 60 defines an entrance/exit slot 82 at one end and a card retention slot 84 at the opposite end. When a card is inserted by a user, the first pair of rollers 74 pinch the leading edge of the card and draw the card into the housing 60. When the trailing edge of the card clears the shutter 66, the shutter 66 closes thereby capturing the card within the housing 60, and the card reading operation begins.

The housing 60 includes four sensors for accurately locating the position of the card within the housing 60.

An orientation sensor 86 is located in the vicinity of the throat portion 62 at the first pair of rollers 74. The sensor 86 is in the form of a magnetic flux detector for detecting the orientation of a card inserted into the housing 60. If the sensor 86 does not detect a magnetic stripe then the card is ejected and the user may be requested (via the display) to re-orient and then re-insert the card.

A card eject sensor 88 is located a predetermined distance from the throat portion 62 to ensure that on ejection of a card the card protrudes from the throat portion 62 by a sufficient distance to allow a user to grip the card.

A card read sensor 90 is located at the second pair of rollers 76 in the vicinity of a card read head 92 so that when the leading edge of a card is detected, the magnetic stripe on the card may be read by the card read head 92.

A card stop sensor 94 is located distal from the throat portion 62 at the third pair of rollers 78. The card stop sensor 94 is spaced from the card read sensor 90 by a distance less than the length of a standard card, so that when the card stop sensor 94 detects the leading edge of a card, the card is still in contact with the card read sensor 90.

The card is only transported beyond the card stop sensor 94 if the card is to be conveyed out of the retention slot 84 and retained by the card reader module 50, for example, because a user has inserted the wrong PIN on a predetermined number of occasions, or because the card is registered as stolen.

The four sensors 86,88,90,94 are located so that once a card enters the housing 60 it can always be located by at least one of the sensors 86,88,90,94, unless the card is conveyed out of the retention slot 84.

In the event of a fraudulent third party placing a length of thin, strong, material (not shown) over the ATM card entry slot 22, the operation of the ATM 10 would be as follows.

An unwary user may approach the ATM 10 and insert his card into ATM card entry slot 22. The card enters throat slot 64; deflects card width sensor 68, thereby opening the shutter 66; enters the housing 60; is pinched by first rollers 74; and is drawn into housing 60. However, as the card is being drawn into housing 60 the material (not shown) stops the card from fully entering the housing 60. At this position part of the card is still underneath the shutter 66 so that the shutter 66 cannot close. Sensor 86 detects the presence of the card, but sensor 90 does not detect the presence of a card. After a predetermined length of time, for example ten seconds, the module 50 attempts to eject the card; however, the material (not shown) stops ejection of the card. Thus the module can neither draw in nor eject the card.

After another predetermined time (for example, 30 seconds) during which sensor 86 detects the presence of a card but sensor 90 does not detect the presence of a card, the module 50 informs an ATM controller 52 (FIG. 2) that a card has jammed and the ATM controller 52 activates stepper motor 42 to lower the ATM shutter 34. When the ATM shutter 34 has been lowered, the card is no longer accessible from outside the ATM 10. The ATM controller 52 displays a message on the display informing the user that the card has been retained. The display may also provide details of how to apply for their card back or for a new card.

The ATM controller 52 then informs a service center that it is out of operation due to possible fraud. A service engineer is then called to remove the material and the card so that the ATM 10 is restored to working order. To remove the card, the service engineer lifts the fascia 12 and depresses button 44 (FIG. 2) on the stepper motor 42. Button 44 rotates the motor 42 clockwise to raise the ATM shutter 34. The engineer can then remove the material and the card in a similar way to the third party.

Various modifications may be made to the above described embodiment within the scope of the invention, for example, the shutter mechanism may be implemented in a number of different ways. The ATM shutter 34 may move from one side to an opposite side rather than from the top to the bottom of the enclosure. The enclosure 30 storing the ATM shutter 34 may be implemented to the rear of the fascia 12, so that a user cannot see the enclosure 30. The predetermined time period when one sensor detects a card but another sensor does not detect a card may be longer or shorter than 30 seconds. Any convenient combination of the sensors 68,86,88,90 may be used (for example sensor 68 and sensor 90; or, sensor 86 and sensor 90) to detect that a card has jammed within the housing 60. The self-service terminal may be a non-cash kiosk. In other embodiments, the ATM shutter 34 may cover the entire user interface 16 of the ATM 10.

What is claimed is:

1. A self-service terminal comprising:

a fascia including a card entry slot for receiving a user card;

a card reader module located behind the card entry slot for reading said card;

a terminal shutter disposed adjacent said entry slot;

means for detecting jamming of said card at said entry slot; and means for moving said terminal shutter to cover said entry slot upon detection of said jamming and prevent outside access to said jammed card.

2. A terminal according to claim 1, wherein said card reader module includes a throat slot aligned with said entry slot, and a second shutter disposed adjacent said throat slot for controlling entry access of said card into said module.

3. A terminal according to claim 1, wherein said jamming detecting means comprise a plurality of sensors disposed inside said card reader module for detecting presence of said card at different locations therein.

4. A terminal according to claim 1, wherein said jamming detecting means are configured to detect jamming of said card inside said throat slot preventing closure of said second shutter.

5. A terminal according to claim 4, wherein said terminal shutter is disposed outside said fascia, and said second shutter is disposed inside said fascia.

6. A terminal according to claim 1, wherein said terminal shutter moving means comprise a rack and pinion operatively joined to a stepper motor for selectively lowering and raising said terminal shutter at said entry slot.

7. A self-service terminal comprising:

a card reader module including means for detecting jamming within the module of a user card inserted therein for accessing said terminal;

a terminal shutter for selectively blocking access to the card reader module; and means for moving said terminal shutter to capture said user card inside said card reader module in response to detection of said card jammed within the module.

8. A terminal according to claim 7, wherein the shutter is retractable.

9. A terminal according to claim 7, wherein said card reader module includes an entry slot, and the shutter is sized to cover only the card entry slot.

10. A terminal according to claim 7, further comprising a fascia including a card entry slot, and wherein the shutter is sized to cover substantially the entire fascia.

11. A terminal according to claim 10, wherein the fascia further includes a display, and the shutter includes a transparent portion to allow a user to view a message on the display.

12. A terminal according to claim 7, further comprising means for activating an alarm on detecting a jammed card which is unable to be transported.

13. A method of preventing fraud in a self-service terminal having a card entry slot, the method comprising:

receiving a user card through the card entry slot;

detecting entry of the card into a card reader module disposed behind the entry slot;

monitoring transport of the card within the card reader module; and activating a shutter to cover the card entry slot and capture said card in response to detection of a failure of the card reader module to transport the card correctly.

14. A method according to claim 13, further comprising:

detecting continued activation of a first sensor but not detecting activation of a second sensor within a predetermined time in monitoring transport of the card in the module to determine jamming thereof.

15. A method of preventing fraud in a self-service terminal having a card entry slot, the method comprising the steps of:

(a) receiving a user card through the card entry slot;

(b) transporting the card within a card reader module disposed behind the entry slot;

(c) monitoring transport of the card within the card reader module to detect a failure of the card reader module to transport the card correctly; and (d) activating a shutter to cover the card entry slot and capture said card when a failure of the card reader module to transport the card correctly is detected in monitoring transport of the card in the module to determine jamming thereof.

16. A method according to claim 15, wherein step (c) includes the steps of:

(c-1) monitoring status of an activatable first sensor which, when activated, provides a first signal indicative of the card being in the vicinity of the first sensor; and (c-2) monitoring status of an activatable second sensor which, when activated, provides a second signal indicative of the card being in the vicinity of the second sensor.

17. A method according to claim 16, wherein step (d) includes the step of:

(d-1) activating the shutter to cover the card entry slot when one of the sensors is activated and remains activated and the other sensor remains inactivated for a predetermined amount of time.

18. A motorized card reader module for use in a self-service terminal having a fascia including a card entry slot for receiving a user card, the module comprising:

at least two sensors for detecting the presence of a magnetic stripe card inserted into said module by a user;

means for generating an alert signal when the card has entered the module and is unable to be transported by the module; and means for capturing said card in said module to prevent access thereto by said user when non-transportable.

19. A motorized card reader module for use in a self-service terminal having a fascia including a card entry slot for receiving a user card, the module comprising:

a transport mechanism for transporting a card inserted into said module by a user;

an activatable first sensor for, when activated, providing a first signal which is indicative of the card being in the vicinity of the first sensor;

an activatable second sensor for, when activated, providing a second signal which is indicative of the card being in the vicinity of the second sensor;

means responsive to the first and second signals for generating an alert signal which is indicative of the card being unable to be transported by the transport mechanism when one of the first and second signals is present and the other one of the first and second signals is absent for a predetermined amount of time; and means for capturing said card in said module to prevent access thereto by said user when non-transportable.

* * * * *